United States Patent [19]

Tachibana et al.

[11] 4,420,363

[45] Dec. 13, 1983

[54] ONE-BATH ETCHING METHOD FOR PROCESSING GRAVURE PLATE, AND ETCHING CONDITION CALCULATING DEVICE

[75] Inventors: Eiichi Tachibana, Toda; Tetsuro Katsuta, Tokyo, both of Japan

[73] Assignee: Dai Nippon Insatsu Kabushiki Kaisha, Tokyo, Japan

[21] Appl. No.: 444,517

[22] Filed: Nov. 26, 1982

[30] Foreign Application Priority Data

Dec. 4, 1981 [JP] Japan ..... 56-195354
Feb. 12, 1982 [JP] Japan ..... 57-20888

[51] Int. Cl.[3] ..... B41C 1/00

[52] U.S. Cl. ..... 156/627; 156/345; 156/905

[58] Field of Search ..... 156/345, 626, 627, 658, 156/659.1, 654, 905; 430/306, 307; 324/71 E

[56] References Cited

U.S. PATENT DOCUMENTS 3,496,046 2/1970 Lootvoet ..... 156/345

*Primary Examiner*—William A. Powell
*Attorney, Agent, or Firm*—Parkhurst & Oliff

[57] ABSTRACT

In a one-bath etching process in which gravure cells are formed in the surface of a gravure cylinder with one kind of etching solution having a predetermined density, in order to control the cell depths by suitably selecting the cylinder speed, data is provided by correlating a permeation characteristic which is obtained by an inspecting solution substantially similar in characteristic to the etching solution to that which is obtained by the etching solution, while data is obtained by correlating to cylinder speeds, and these data are compared with data which are obtained from the resist layer of the cylinder which is to be used for printing, to determine the total etching time and the cylinder speeds.

5 Claims, 27 Drawing Figures

ROTATIONAL SPEED $R_a$

| | A | | B | | C | | D | | E |
|---|---|---|---|---|---|---|---|---|---|
| $T_1$ | $xA_1$ | $yA_1$ | $xB_1$ | $yB_1$ | $xC_1$ | $yC_1$ | $xD_1$ | $yD_1$ | |
| $T_2$ | $xA_2$ | $yA_2$ | $xB_2$ | $yB_2$ | $xC_2$ | $yC_2$ | | | |
| $T_3$ | $xA_3$ | $yA_3$ | $xB_3$ | $yB_3$ | | | | | |
| $T_4$ | $xA_4$ | $yA_4$ | | | | | | | |
| $T_5$ | $xA_5$ | | | | | | | | |
| $T_6$ | $xA_6$ | | | | | | | | |
| | | | | | | | | | |

FIG. 25

RESIST CHECK

——INPUT DATA——

| | x (sec) (MEASURED VALUE) | y (μ) (SET PERMEATION TIME) |
|---|---|---|
| A | 1.6 | 35.0 |
| B | 4.7 | 20.0 |
| C | 16.0 | 10.0 |
| D | 47.5 | 2.0 |

——OUTPUT DATA——

∘ TOTAL ETCHING TIME 11 min 0 sec

∘ ETCHING DISTRIBUTION

| | | | |
|---|---|---|---|
| 1 st PERIOD | 1 min | 30 sec | rpm |
| 2 nd PERIOD | 2 min | 0 sec | 40 rpm |
| 3 rd PERIOD | 7 min | 30 sec | 20 rpm |

∘ FORECAST ERROR (FORECAST DEPTH)

| | | |
|---|---|---|
| 1 | + 1.0 | (36.0) |
| 2 | + 0.5 | (20.5) |
| 3 | + 0.3 | (10.3) |
| 4 | + 0.1 | ( 2.1) |

∘ ETCHING ADVANCEMENT "YES"

ONE-BATH ETCHING METHOD FOR PROCESSING GRAVURE PLATE, AND ETCHING CONDITION CALCULATING DEVICE

BACKGROUND OF THE INVENTION

This invention relates to a one-bath etching method for processing a gravure plate, and a device which, in order to etch a gravure plate according to a variable rotational speed one-bath etching method, the permeation characteristic of a resist layer is obtained in advance, thereby to provide most suitable etching conditions before the etching operation.

A gravure plate processing one-bath etching method is excellent in etching control. In the method, while a ferric chloride solution having a predetermined density is being supplied to the cylinder surface, the cylinder rotational speed is varied, so that an aimed cell depth curve is obtained. In the conventional method, during etching, the cell depths of the shadow-most portion and a desired portion are detected, and whenever the cell depth of the desired portion coincides with an intermediate set value, the cell-depth of the shadow-most portion is measured, so that when the depth thus measured is larger than a predetermined value, the rotational speed is decreased, and when smaller, the speed is increased, to adjust the cell depth.

Thus, the conventional method can control the cell depths at only two points. Therefore, agreement of the cell depths of half-tone portions cannot be detected until the etching operation is finished.

The above-described conventional method is of the feedback control type, and accordingly needs a cell depth sensor and an arithmetic control unit. Thus, the etching machine is necessarily intricate in construction.

SUMMARY OF THE INVENTION

An object of this invention is to overcome the above-described difficulties accompanying a conventional gravure plate processing one-bath etching method.

Provided according to a first aspect of the invention is a preset type one-bath etching process in which etching characteristics in the combinations of etching times and cylinder speeds are obtained in advance, so that the etching characteristics thus obtained are compared with a cell depth curve to determine the total etching time and a cylinder speed, or the cell depth curve is divided for every part high in correlation, so that the etching times and the rotational speeds to be used in the parts of the curve are detected successively beginning with those for the late etching period, and the etching operation is carried out according to the etching times and rotational speeds thus detected.

Furthermore, provided according to another aspect of the invention is a device in which an inspecting solution correlative in gravure plate resist layer permeation characteristic to an etching solution is dropped onto a portion of the resist layer on the cylinder surface, which is to be inspected, the resist layer permeation characteristic of the inspecting solution is measured by an electrical resistance method, and the results of measurement are compared with reference data which have been predetermined, thereby to determine etching conditions in a variable rotational speed one-bath etching method, the etching conditions being utilized as data inputs in the next etching process.

The reference data which should be predetermined are the relationships between inspecting solution permeation times and etching solution permeation times, with respect to the gradations of a testing gradation scale, of the resist layer, and the relationships between inspecting solution permeation times and copper surface etching speeds (or amounts of etching per actual etching time) with respect to cylinder rotational speeds. These are stored, in the form of tables or approximate functional equations, in a memory circuit. The data which are provided by measuring with the same inspecting solution permeation times with respect to the gradations of the gradation scale on the gravure plate resist layer and the set cell depths with respect to the gradations are compared with the data stored in the memory circuit, so that most suitable etching conditions which are in agreement with the characteristic of the resist layer, namely, the total etching time, distributed etching times and rotational speeds are calculated through arithmetic operation before the etching operation.

The nature, principle and utility of the invention will become more apparent from the following detailed description when read in conjunction with the accompanying drawings.

BRIEF DESCRIPTION OF THE DRAWINGS

In the accompanying drawings:

FIG. 25 is a diagram showing one example of the output of an output section in the device in FIG. 17;

DETAILED DESCRIPTION OF THE INVENTION

First, a method of inspecting a gravure plate material for the permeation characteristic of its resist layer with an inspecting solution will be described. The inspecting solution is an electrically conductive solution which essentially contains polyhydric alcohol, thus being not corrosive or somewhat corrosive.

Figure 1:
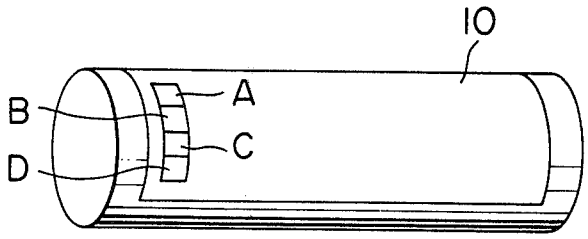
FIG. 1 is a perspective view of a gravure cylinder.

FIG. 1 shows a cylindrical gravure plate material. A resist layer 10 is formed on the copper layer of the cylindrical gravure plate material. A pattern to be printed is developed on the resist layer 10, and an inspecting gradation scale (consisting of four gradations A, B, C and D for instance) are also formed on the resist layer 10.

Figure 2:
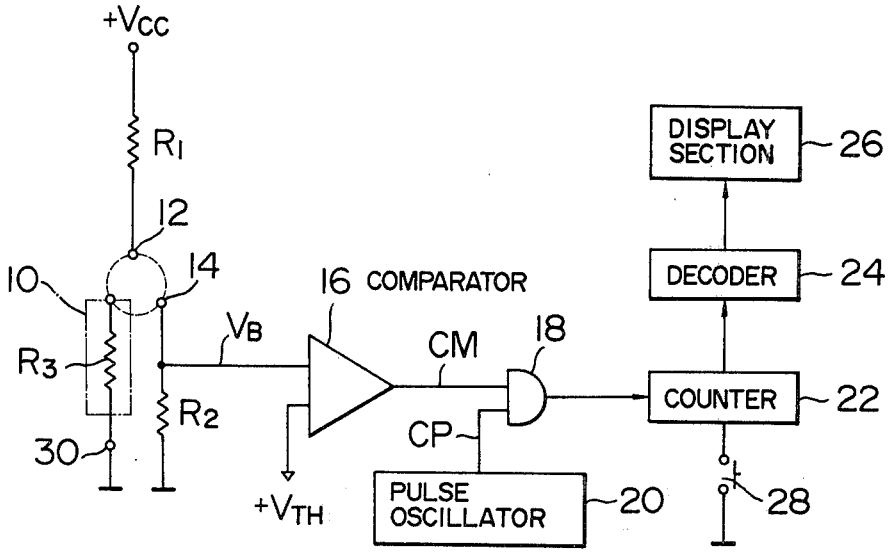
FIG. 2 is a circuit diagram showing one example of a measuring circuit in a resist inspecting device.
Figure 3:
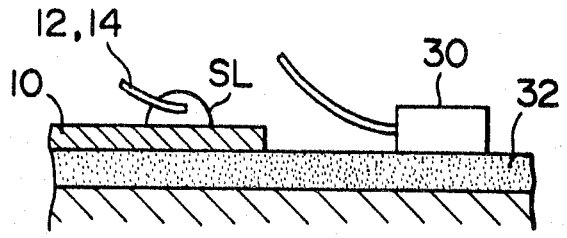
FIG. 3 is an explanatory diagram showing the resist inspecting device on the cylinder.

FIG. 2 shows a device for detecting the characteristic of such a resist layer, and FIG. 3 shows the device which is in operation. As shown in FIG. 3, a resist electrode 12 is connected through a resistor $R_1$ to a power source +Vcc, and another resist electrode 14 is grounded through a resistor $R_2$. The potential $V_B$ of the electrode 14 is applied to one input terminal of a comparator 16 to the other input terminal of which a threshold potential $V_{TH}$ is applied. The output CM (binary signal) of the comparator 20 is applied to one input terminal of an AND circuit 18, to the other input terminal of which a clock pulse having a predetermined frequency is applied by a pulse oscillator 20. The output of the AND circuit 18 is counted by a counter 22. The count value of the counter 22 is applied through a decoder 24 to a display section 26, where it is displayed as permeation time data. The counter value of the counter 22 is reset by operating a clear button 28. In FIG. 2, a resistor $R_3$ represents the resistance of the resist layer 10. The resist layer 10 is grounded through an electrode 30. In the case of FIG. 3, the resist layer 10 is connected through the electrode 30.

Figure 4:
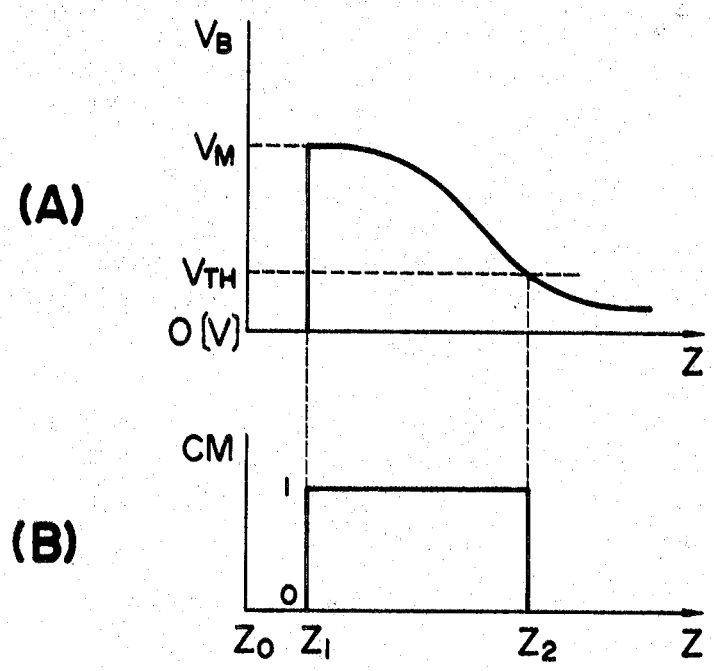
FIG. 4 is a waveform diagram showing signals in the measuring circuit in FIG. 2.

When the power switch (not shown) is turned on, the inspecting operation is started. In this case, as the resist electrode 14 is grounded through the resistor $R_2$, the potential $V_B$ is OV as indicated between the time instants $Z_0$ and $Z_1$ in the part (A) of FIG. 4; i.e., it is lower than the threshold potential ($+V_{TH}$). Accordingly, the output of the comparator 16 is at a logical level "0" (hereinafter referred to merely as "0", when applicable) as shown in the part (B) of FIG. 4. Therefore, the clock pulse CP is blocked by the AND circuit 18 and is not counted by the counter 22.

When, under this condition, the electrically conductive inspecting solution SL is dropped onto the resist electrodes 12 and 14 on the resist layer 10 by using a squirt, the inspecting solution SL is brought into contact with the resist layer 10 and the resist electrodes 12 and 14. As a result, from the time instant $Z_1$ (when the inspecting solution has been dropped) current from the power source +Vcc starts to flow through the resistor $R_1$ to the resistors $R_2$ and $R_3$. Accordingly, the potential $V_B$ is divided into a voltage division value $V_M$ by the composite resistance of the resistors $R_1$, $R_2$ and $R_3$ (cf. the part (A) of FIG. 4), which is applied to the comparator 16. As the voltage division value $V_M$ is higher than the threshold potential $+V_{TH}$, the output CM of the comparator 16 is raised to a logical level "1" (hereinafter referred to merely as "1", when applicable) as shown in the part (B) of FIG. 4. As a result, the clock pulse CP is applied through the AND circuit 18 to the counter 22. The count value of the counter 22 is converted into time data by the decoder 24, so that the lapse of time from the count start time $Z_1$ is displayed on the display section 26.

As the inspecting solution SL permeates the resist layer 10 gradually, the resistance $R_3$ thereof is gradually decreased. Accordingly, the potential $V_B$ is decreased gradually from the time instant $Z_1$ as shown in the part (A) of FIG. 4, and finally becomes lower than the threshold potential $V_{TH}$ (at the time instant $Z_2$). At the same time, the output of the comparator 16 is set to "0" again, the clock pulse CP from the pulse oscillator 24 is blocked by the AND circuit 18, and the counting operation of the counter 22 is suspended. Thus, the counter 22 counts the clock pulses CP which are generated by the pulse oscillator 20 for the period of time between the time instants $Z_1$ and $Z_2$, i.e., for the period of time which elapses from the time instant that the inspecting solution SL is dropped onto the resist layer 10 until the inspecting solution permeates to a predetermined depth (corresponding to the threshold potential $+V_{TH}$), and the count value of the counter 22 is converted into time data by the decoder 24, which is displayed as the permeation time on the display section. Thus, the permeation time of the inspecting solution SL in the resist layer 10 can be measured. The count value of the counter 22 can be reset by depressing the clear button 28 as described before.

The above-described measurement is carried out for the portions of the resist layer which are of the four gradations (A, B, C, D) of the gradation scale, so that the respective permeation times are detected.

Figure 5:
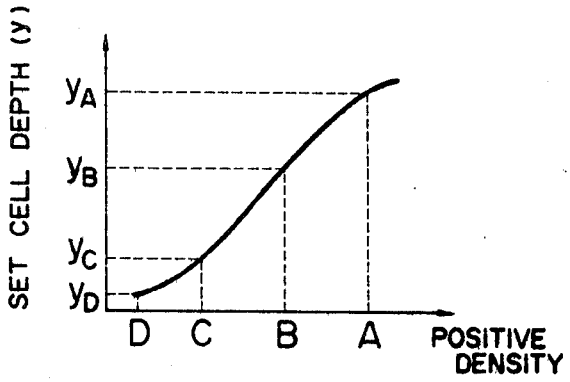
FIG. 5 is a graphical representation indicating positive density with set cell depth.

Cell set depths, which correspond to the gradations of the gradation scale, correspond to the positive densities of an original as shown in FIG. 5. The relation curve in FIG. 5 is suitably determined through experiment according to the kinds of originals.

Figure 6:
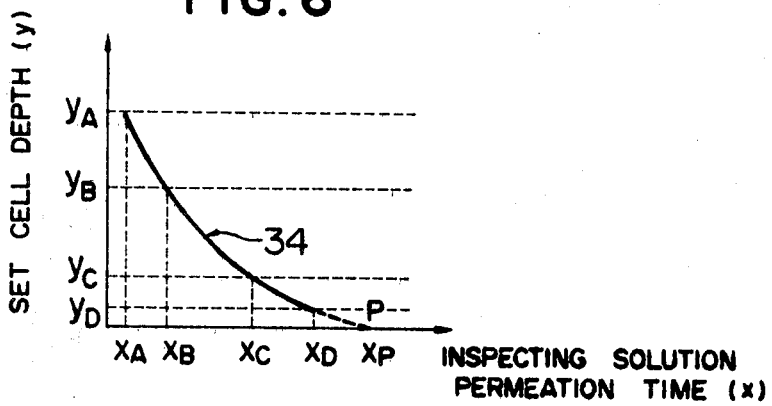
FIG. 6 is a graphical representation indicating inspecting solution permeation time with set cell depth, which has a logarithmic horizontal axis.
Figure 7:
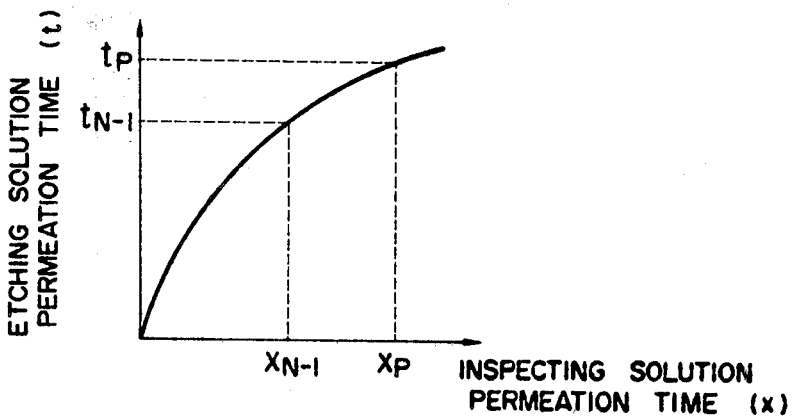
FIG. 7 is a graphical representation indicating inspecting solution permeation time with etching solution permeation time.

The cell set depths are in correlation with the above-described inspecting solution permeation times as indicated in FIG. 6. The inspecting solution permeation times are in correlation with etching solution permeation times as shown in FIG. 7. In this case, the density of the etching solution is maintained constant. Therefore, if the density of the etching solution is changed, then the curve illustrated is changed. It has been confirmed through experiment that the curve is constant substantially irrespective of the speed of rotation of the cylinder.

Figure 8:
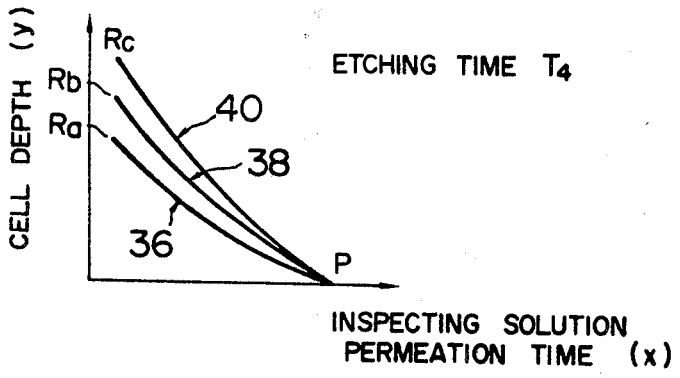
FIG. 8 and FIG. 14 are graphical representation indicating inspecting solution permeation times with cell depths with the rotational speed changed, which have logarithmic horizontal axes.

When an etching solution the density of which is maintained unchanged is used to etch the cylinder surface, the amount of etching depends on the speed of the cylinder. In other words, the amount of etching is small when the speed of the cylinder is low, while it is large when high. When the speed of the cylinder (or the etching time) is maintained unchanged, the inspecting solution permeation times are in predetermined correlation with the cell depths as shown in FIG. 8 (or 9).

The permeation characteristic as shown in FIG. 6 is obtained from the results of measurement provided by the above-described inspecting device. Then, the total etching time, the speeds of various cylinders to be used, etching times under the speeds, and a speed change procedure can be obtained by comparing the permeation characteristic thus obtained with those in FIGS. 7, 8 and 9 and through arithmetic operation.

Method of obtaining data in FIGS. 8 and 9 will be described.

Figures 10, 11:
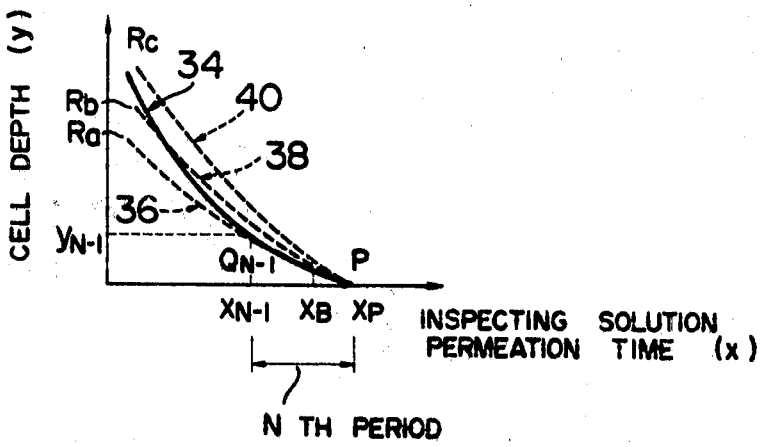
FIG. 10 is a table showing one example of the test result of a testing resist layer.
FIG. 11 is a graphical representation having a logarithmic horizontal axis, which indicates inspecting solution permeation times with cell depths, comparing the graph in FIG. 6 with that in FIG. 8.

For each of the cylinder speeds Ra, Rb, Rc, . . . , a predetermined resist layer is tested to obtain etching times, inspecting solution permeation times and cell depths. FIG. 10 indicates the results of the test which is performed with the cylinder speed Ra.

The testing resist layer is formed on the copper layer of the cylinder. A testing gradation scale ranged from shadow to high light is formed on the resist layer. The resist layer is divided into areas having gradations A, B, C, . . . . Each area has a region for the inspecting solution and a region for the etching solution.

The inspecting solution is dropped onto the predetermined regions of the gradations A, B, C, . . . , to measure the permeation times $xA_1$, $xA_2$, . . . $xB_1$, . . . $xD_6$, . . . . The etching solution is applied to the other regions respectively for etching periods $T_1$, $T_2$, $T_3$, . . . . Thereafter, the resist layer is removed to measure the depths $yA_1$, $yA_2$, . . . $yB_1$, . . . . The above-described measurement is carried out for the remaining cylinder speeds B, C, . . . .

FIG. 8 is a graph indicating the above-described results of measurement, with the etching time $T_4$. The graph shows inspecting solution permeation time (x) with cell depth (y) with respect to the cylinder speeds Ra, Rb and Rc. Such graphs (not shown) are drawn with respect to the other etching times $T_1$, $T_2$, . . . .

Figure 9:
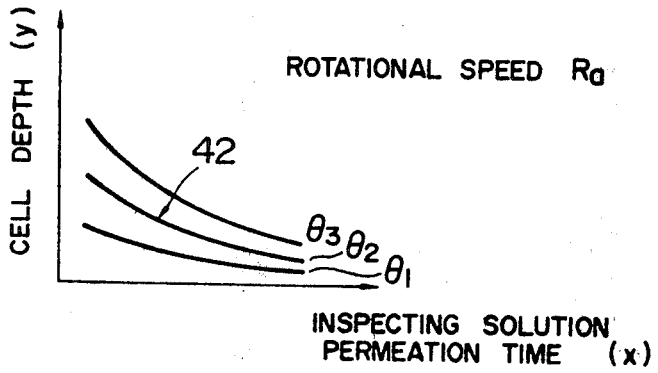
FIG. 9 is a graphical representation having a logarithmic horizontal axis, which shows inspecting solution permeation times with cell depths with the actual etching time changed.

According to the above-described results of measurement, a graph as shown in FIG. 9 is drawn. The graph indicates inspecting solution permeation time (x) with cell depth (y) with respect to actual etching times $\theta_1$, $\theta_2$, $\theta_3$, . . . when the cylinder speed Ra is employed. Such graphs (not shown) are drawn with respect to the other cylinder speeds Rb, Rc, . . . and so forth.

The actual etching time $\theta$ can be obtained from the following equation:

$$T=t+\theta$$

where t is the etching solution permeation time, which is the time interval which elapses from the time instant that the etching solution is dropped onto the resist layer until the resist layer is blackened by the reaction of the etching solution with the copper, and T is the etching time.

That is, the actual etching time is the period of time which elapses from the time instant that the etching solution reaches the copper surface of the cylinder until it actually etches the copper surface.

The above-described inspecting solution permeation times and etching solution permeation times are utilized to draw a graph as shown in FIG. 7. In the graph, the horizontal axis represents the permeation times (x) of the inspecting solution in the areas of the gradations, and the vertical axis represents the permeation times (t) of the etching solution in the same areas.

The correlation between the inspecting solution permeability and the cell depth is obtained as described above. With the correlation as the reference data, the results of the measurement which is carried out for the permeability of the resist layer 10 by using the inspecting solution are utilized, so that etching conditions can be determined before etching is carried out.

The properties of resist are changed as temperature or humidity changes. Therefore, even if a gravure plate is processed with great care, it is desirable that the permeation characteristic is detected by using the inspecting solution before etching. The cell depths which the areas of the gradations A, B, C, and D in FIG. 1 should have been determined through experiment. Referring to this, the relation between inspecting solution permeation time and cell depth for each gradation area is drawn as shown in FIG. 6.

Next, a point where the permeation characteristic curve 34 intersects with the X-axis in FIG. 6, i.e., a point p where the cell depth $y=0$ is estimated. The inspecting solution permeation time (xp) at the point. Then, the etching solution permeation time (tp) which corresponds to the inspecting solution permeation time is obtained from FIG. 7. The time thus obtained is employed as the total etching time. It goes without saying that the point p may be determined by actually obtaining the inspecting solution permeation time of a part of the resist layer where the cell depth should be zero ($y=0$).

The above-described point p may be obtained as a point where the straight line connecting two points ($x_C$, $y_C$) and ($x_D$, $Y_D$) intersects the X-axis, or as a point where the tangential line which touches the curve 34 at the point ($x_D$, $y_D$) intersects the X-axis.

The total etching time tp is determined as described above. If the total etching time is equal to $T_4$ for instance, then the relations between inspecting solution permeation time and cell depth with respect to a plurality of cylinder speeds corresponding to that time are selected (FIG. 8) and are compared with the curve 34 in FIG. 6.

It is most desirable that conditions are so set that the resist layer 10 is etched along the curve 34 in FIG. 6. Therefore, the relation which is closest to the curve 34 is selected. If the relation is, for instance, for the case where the cylinder speed Rb is selected, then it is determined that the cylinder speed Rb and the total etching time $T_4$ are employed in the etching operation.

However, sometimes the curve 34 cannot be followed with only one cylinder speed Rb. In such a case, the etching period is divided into N parts, and for each of the N parts optimum etching conditions are set.

If the total etching time tp is equal to $T_4$ for instance, then the data in FIG. 8 which corresponds to that time is selected, and is subjected to comparison as shown in FIG. 11. As it is desirable that the resist layer 10 is etched along the curve 34, one of the curves in FIG. 8 which is closer to the curve 34 is selected through comparison relating to inspecting solution permeation time from the right side. That is, the etching conditions are set beginning with those for the last etching period, or the N-th etching period (N=2, 3, 4, 5, . . . ). In this case, the right side of the point $Q_{N-1}$ is close to the curve 36. Accordingly, by being affected by the speed Ra, the portion of the resist layer in which the inspecting solution permeation time is ranged from $x_{N-1}$ to $x_D$ can be etched along the part of the curve 34 which is after the point $Q_{N-1}$.

Thus, it is determined that the speed Ra is used in the N-th etching period.

The time of use of the speed Ra thus determined is obtained by subtracting a period of time is required for the etching solution to permeate the portion of the resist layer which corresponds to the inspecting solution permeation time $x_{N-1}$ at the point $Q_{N-1}$, from the total etching time $T_4$ which has been determined as described above.

The time of use of the speed Ra is obtained by subtracting the etching solution permeation time $t_{N-1}$ corresponding to the inspecting solution permeation time $x_{N-1}$ from the total etching time $T_4$ $(T_4-t_{N-1})$.

A method of obtaining a speed to be used before the N-th etching period and the time of use of the speed will be described.

Figure 12:
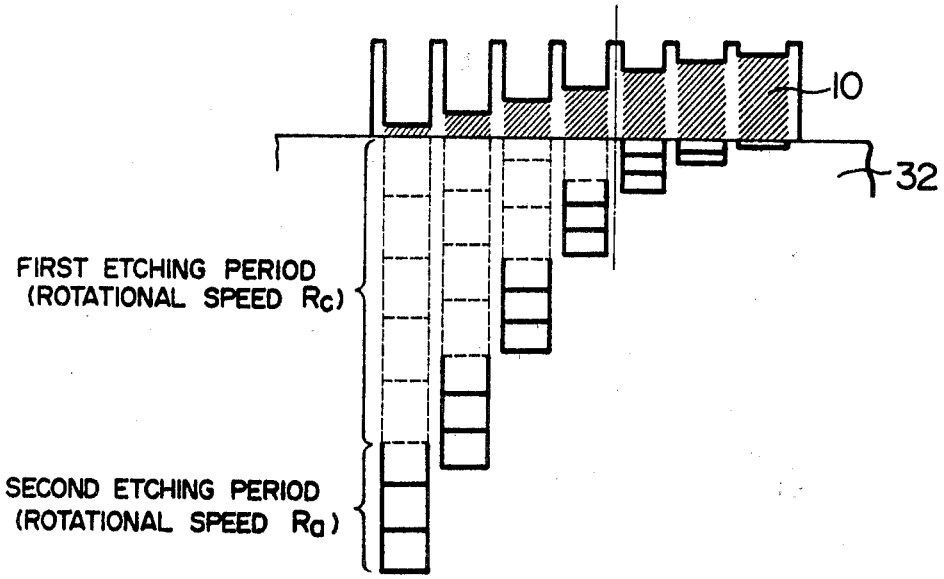
FIG. 12 is a sectional view showing a part of the resist and copper layers of the cylinder.

FIG. 12 is an explanatory diagram showing the amounts of etching in the case where the etching period is divided into the first and second etching periods (N=2). In FIG. 12, in the copper layer 32 the amounts of etching in the first etching period are indicated by the broken lines, and those in the second etching period are indicated by the solid lines. As shown in FIG. 12, the copper layer is etched stepwise in the first and second etching periods, and the cell depths in the etching periods are in correlation with the rotational speeds and the actual etching times.

Accordingly, a border line (indicated by the chain line) is formed by the difference between the rotational speeds of the first and second etching periods, as shown in FIG. 12. The portion of the resist layer, which is on the right side of the border line and is relatively long in inspecting solution permeation time, is affected by the rotational speed of the second etching period, while the portion of the resist layer, which is on the left side of the border line and is relatively short in inspecting solution permeation time, is affected by the rotationals speeds of the first and second etching periods. The rotational speed of the first etching period affects the cell depth (indicated by the broken lines) which is obtained by subtrating the cell depth (indicated by the solid lines) due to the rotational speed of the second etching period in the portion of the resist layer, which is on the left side of the border line.

Thus, in general, in the case of N etching periods, detection of a rotational speed which affects a new curve which is obtained by subtracting the effect of the rotational speed of the N-th etching period from the permeation characteristic curve 34 in FIG. 6 can provide rotational speed to be used before the N-th etching period and the times of use of the speeds.

Figure 13:
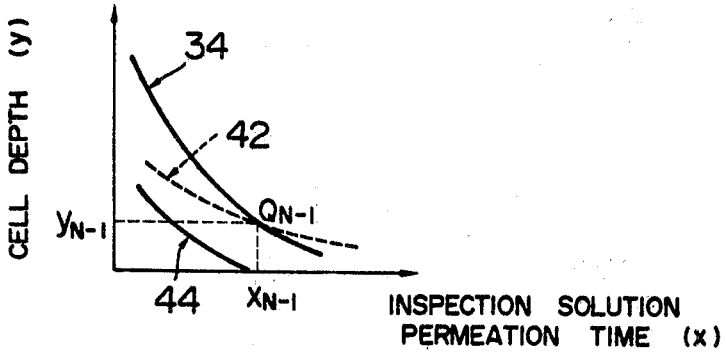
FIG. 13 is a graphical representation having a logarithmic horizontal axis, which indicates inspecting solution permeation times with cell depths, comparing the graph of FIG. 6 with that of FIG. 9.

In FIG. 11, the cell depth $Y_{N-1}$ at the point $Q_{N-1}$ is obtained. Then, in FIG. 9, the actual etching time $\theta_2$ with respect to the rotational speed Ra providing the cell depth is obtained. Thereafter, a new curve 44 is obtained by subtracting the actual etching time $\eta_2$ and the curve 42 of the speed Ra from the permeation characteristic curve 34 as shown in FIG. 13.

The curve 44 thus obtained represents etching conditions before the N-th etching period. Accordingly, the intersection of the curve 44 and the horizontal axis indirectly indicates an ething time required before the N-th etching period. That is, the etching time is a period of time $t_{N-1}$ which is required for the etching solution to permeate the portion of the resist layer which corresponds to the inspecting solution permeation time $x_{N-1}$. The period of time is equal to that $(T_4-(T_4-t_{N-1}))$ which is obtained by subtracting the time of use of the speed A $(T_4-t_{N-1})$ from the total etching time $T_4$.

Figure 14:
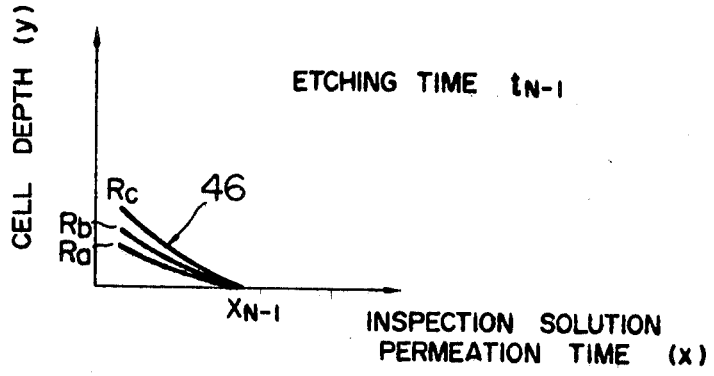
Figure 15:
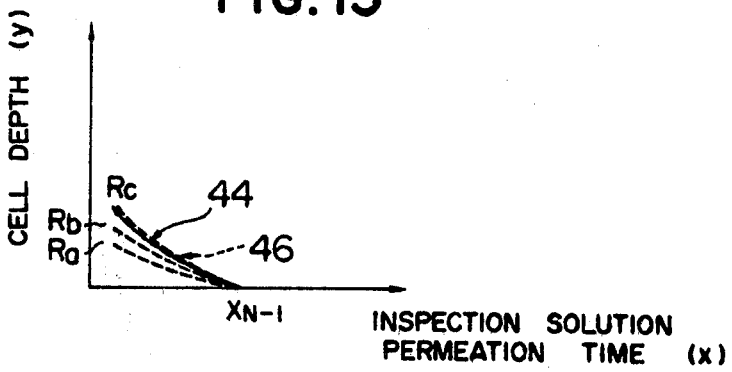
FIG. 15 is a graphical representation with a logarithmic horizontal axis, which indicates inspecting solution permeation times with cell depths, comparing the graph of FIG. 13 with that of FIG. 14.

As shown in FIG. 15, the curve 44 is compared with the inspecting solution permeation time vs. cell depth data with respect to various rotational speeds in the case of the etching time $t_{N-1}$ as shown in FIG. 14, so that, out of the curves in FIG. 14, one which is most similar to the curve 44 is selected. In this case, the curve 46 (FIG. 14) is closest to the curve 44.

Thus, it is determined that the rotational speed Rc is employed in the (N−1)th etching period. In this case, N=2, and it is determined that the etching period is divided into the first and second etching periods.

In the case where the curve 44 obtained as described above is not close to any one of the curves in FIG. 14, the above-described operation is repeated.

Figure 16:
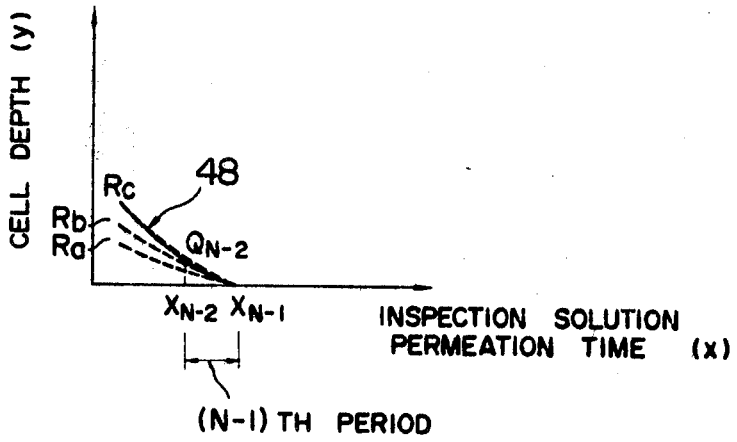
FIG. 16 is a comparison graph similar to that of FIG. 15, in the case where the resist permeation curve does not coincide with the graph in FIG. 14.

It is assumed that a new line 48 is positioned as shown in FIG. 16. In this case, a turnout point $Q_{N-2}$ is determined. On the basis of this determination, the same operations as those described with reference to FIGS. 13, 14 and 15 are carried out, so that etching times and rotational speeds for the (N−1)th and (N−2)th etching periods. In this case, the etching period is divided into the first, second and third etching periods. If the new curve 48 has the (N−3)th turnout point (not shown), the above-described operation is carried out again.

When the results of FIGS. 13, 14 and 15 are obtained, the etching operations of the first and second etching periods are carried out under the conditions, i.e., the cylinder speed Rc and the time $t_{N-1}$, and the cylinder speed Ra and the time $(T_4-t_{N-1})$, respectively. In this case, the etching operation is carried out along the curve 34 in FIG. 6, and accordingly a printing plate having cell depths as desired can be provided.

In general, when (N−1) turnout points are provided, the etching period is divided into N parts, and the etching operations of the first, second, third, . . . and N-th etching periods are carried out under the respective conditions—rotational speeds and times of use of the rotational speeds—in the stated order.

When the characteristic of the resist layer is detected unsatisfactory with the inspecting solution, only the resist layer should be formed again if the inspecting solution is not corrosive. If the inspecting solution is slightly corrosive, then the plate material should be lightly polished, so that a new resist layer is formed thereon. In general, the etching solution is electrically conductive. Therefore, in the case where the inspection has been carried out with the etching solution, it is necessary to use a new plate material.

In the above-described embodiment, the amount of etching is represented by the cell depth. However, if the cell depth is correlated to the cell volume in advance, then the amount of etching can be represented by the cell volume, and the same effects as those described above can be obtained.

The above-described etching conditions may be determined by the following method: Reference data as shown in FIG. 10 are stored in a computer, and arithmetic operations such as for instance comparison of the data thus stored with the data in FIG. 6 are carried out by the computer.

As is apparent from the above description, the invention has the following effects or merits:

(1) Before the etching operation is carried out, the permeation characteristic of the resist layer is detected, so that the etching conditions are determined in conformance with the permeation characteristic thus detected. Therefore, cell depths excellent in reproducibility are obtained in the plate material in accordance with the desired gradations of a pattern to be printed. Thus, a printing plate stable in quality can be provided even by an unskilled person.

(2) Since a printing plate stable in quality can be manufactured as described above, a burden of correcting a printing plate in the after-treatment is greatly reduced.

(3) The etching conditions can be determined from the graphs. Furthermore, in the case where the tests results as shown in FIG. 10 are stored in a computer in advance, the etching conditions can be set by the arithmetic operation of the computer. The etching conditions set by the arithmetic operation can be utilized not only to etch the plate material but also to control the etching machine.

(4) The etching operation can be achieved by rotating the cylinder according to the rotational speed and the time which have been determined in advance. Furthermore, the etching operation can be achieved with only one kind of etching solution. Therefore, the etching procedure and accordingly the etching equipment can be simplified. That is, with an inexpensive etching machine, an etching operation can be carried out with high accuracy.

CONCRETE EXAMPLE 1

The inspecting solution permeation times with respect to the four gradations (1.7, 1.2, 0.8 and 0.4 in positive density) on the resist layer of a gravure plate material to be etched were measured 2.0 sec., 6.3 sec., 17.0 sec. and 49.0 sec., respectively. A graph of "inspecting solution permeation time" vs "set cell depth" was drawn with set cell depths for the gradations being respectively 35 μm, 20 μm, 10 μm and 2 μm. Next, the inspecting solution permeation time 64 sec. was obtained at the point where the permeation characteristic curve in the graph indicated the cell depth=0, and through transformation by the graph of "inspecting solution permeation time" vs "etching solution permeation time" the total etching time was set to 660 sec. (=11 min.). Through comparison with the graph of "inspecting solution permeation time" vs "cell depth" when etching is carried out for eleven minutes with various rotational speeds, a rotational speed of 30 rpm was obtained so as to be used for the etching. Thus, it was found that, in order to provide the set cell depth for the resist layer, the etching should be carried out by using a kind of etching solution (in this case, a 39° Be etching solution) under the cnditions that the total etching time was eleven minutes and the rotational speed was 30 rpm. A touch roller system was employed to carry out the etching operation according to the conditions. The cell depths with respect to the gradations were 36 μm, 21 μm, 10 μm and 2 μm which are roughly equal to the cell depths which were set initially.

CONCRETE EXAMPLE 2

The inspecting solution permeation times with respect to the four gradations (1.7, 1.2, 0.8 and 0.4 in positive density) on the resist layer of a gravure plate material to be etched were measured 1.6 sec., 4.7 sec., 16.0 sec. and 47.5 sec., respectively. A graph of "inspecting solution permeation time" vs "set cell depth" was drawn with set cell depths for the gradations being respectively 35 μm, 20 μm, 10 μm and 2 μm. Next, the inspecting solution premeation time 64 sec. was obtained at the point where the permeation characteristic curve in the graph indicated the cell depth=0, and through transformation by the graph of "inspecting solution permeation time" vs "etching solution permeation time" the total etching time was set to 660 sec. (=11 min.). Through comparison with the graph of "inspecting solution permeation time" vs "cell depth" when etching is carried out for eleven minutes with various rotational speeds, a rotational speed of 20 rpm was obtained so as to be used in the N-th etching period. Then, the (N−1)th turnout point was obtained. The inspecting solution permeation time 4.5 sec. corresponding to the turnout point was converted into the etching time permeation time 90 sec. by the graph of "inspecting solution permeation time" vs "etching solution pemeation time". The difference (570 seconds=9.5 minutes) between the etching time permeation time 90 sec. and the total etching time 660 sec. was determined to be the N-th etching period.

Next, the cell depth 21.5 μm at the (N−2)th turnout point was obtained, and the actual etching time 9.5 min. with the rotational speed 20 rpm, which should provide the cell depth, was obtained. By subtracting the curve in the graph of "inspecting solution permeation time" vs "cell depth", which is for the actual etching time 9.5 min. and the speed 20 rpm, from the above-described permeation characteristic curve, a new curve was obtained and at the same time an etching time 1.5 min. was obtained. When the new curve was compared with the graph of "inspecting solution permeation time" vs "cell depth" with respect to various rotational speeds with the etching time being 1.5 minutes, it was found that the new curve was sufficiently close to the curve of the speed 40 rpm. Therefore, N=2 was determined. At the same time, the rotational speed used for the first etching period was set to 40 rpm, and the time of use of the speed was set to 1.5 minutes.

Thus, in order to provide the set cell depth for the resist layer, one kind of etching solution (in this case, a 39° Be etching solution) should be used so that the etching operations in the first and second etching periods were carried out with the time 1.5 min. and the rotational speed 40 rpm, and the time 9.5 min. and the rotational speed 20 rpm, respectively. The touch roller system was employed to carry out the etching operations according to those conditions. The resultant cells depths with respect to the gradations were 36 μm, 20 μm, 10 μm and 2 μm which were substantially equal to the cell depths which are initially set.

Figure 17:
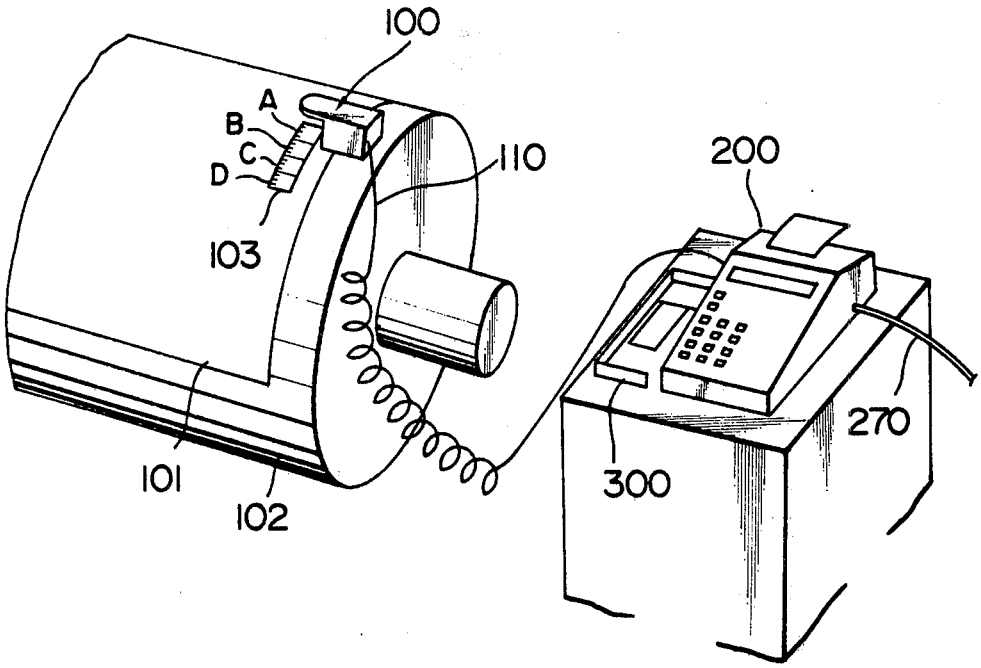
FIG. 17 is an external view showing the entire arrangement of a device according to the invention.

FIG. 17 shows the external appearance of a printing plate resist etching condition calculating device according to the invention. In FIG. 16, reference numeral 101 designates a resist layer formed on the surface 102 of the copper layer of a cylindrical gravure plate material. An image to be printed has been printed and developed on the resist layer 101 and an inspecting gradation scale 103 consisting of plural gradations A, B, C and D ranged from "shadow" to "high-light" is formed on the resist layer 101. The device comprises: a measurement section tool 100 for detecting the permeation characteristic of an inspecting solution dropped at the aforementioned gradation scale; a device body 200 connected through a lead wire 110 to the tool 100, for calculating etching conditions: and a stand for receiving the tool 100. The device operates to calculate etching conditions in a rotation speed variable one bath etching method from the relations between the permeation times of the inspecting solution with the gradations of the gradation scale on the gravure plate resist layer and the amounts of etching for setting cells.

The components of the device shown in FIG. 16 will be described one after another.

First, the measurement section tool 100 for inspecting the permeation characteristic of a gravure plate resist layer with an inspecting solution will be described. The inspecting solution is an electrically conductive solution essentially including polyhydric alcohol, shows a predetermined permeation characteristic with respect to an etching solution including a ferric chloride solution, and is excellent in reproduction.

Figure 18:
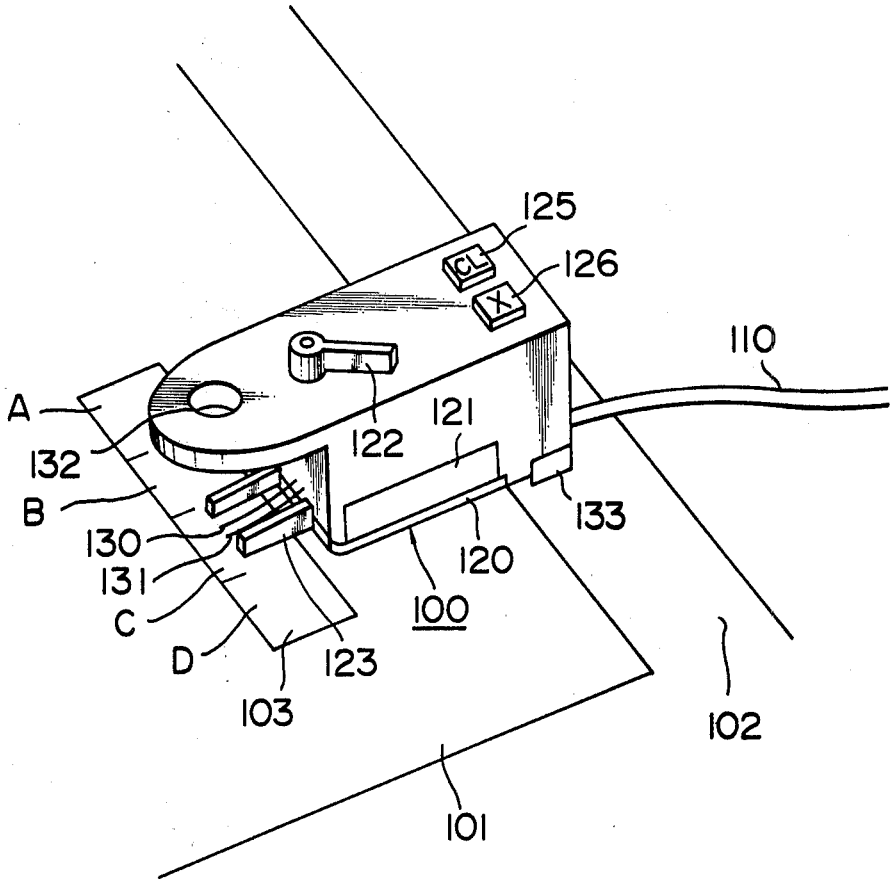
FIGS. 18 and 19 are explanatory diagrams showing the construction of a measurement section tool in the device in FIG. 17.

FIG. 18 shows one example of the measurement section tool 100. The tool 100, as shown in FIG. 18, has a cushion member 120, namely, a rubber or plastic film at the bottom for protecting the gravure plate resist layer 101, and a magnet 121 placed on the cushion member 120. The tool 100 is fixedly set by the force of attraction between the magnet 121 and the magnetic base material of the cylinder 102. The magnet is clamped, in one action, by a handle 122 on the upper surface of the tool 100. In order to make the tool compact, the cramping means may be omitted. If the bottom of the tool 100 is curved inwardly, then the tool can be more positively fixedly set on the cylinder.

A manual operating section including a clear key 125 and an X key 126 for inputting an inspecting solution permeation time display value is provided on the upper surface of the tool 100, and these keys are connected through the lead wire 110 to the device body 200 (described later).

Figure 19:
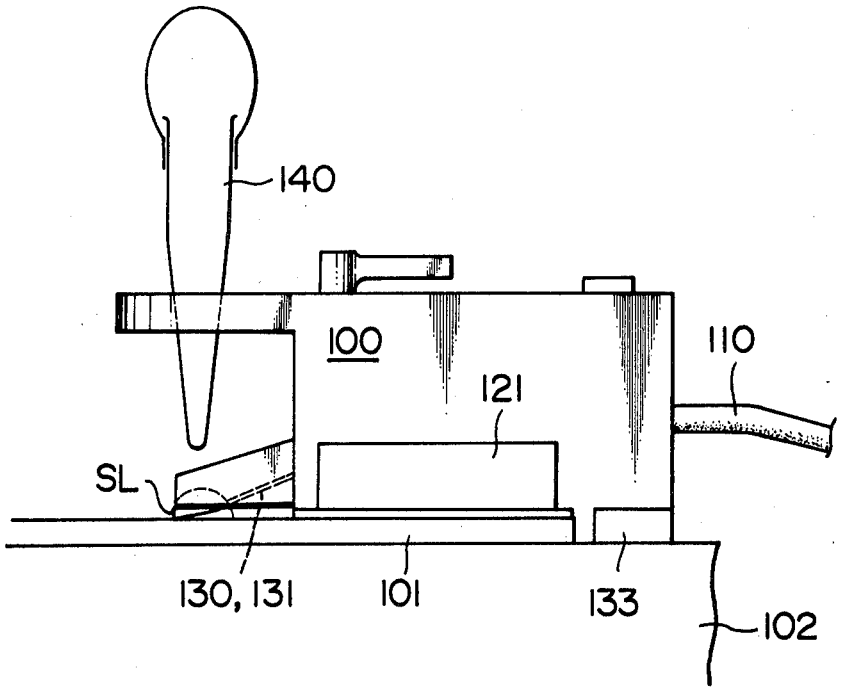

The inspecting method is as follows: Resist electrodes 130 and 131 protected by electrode guides 123, which is brought through the inspecting solution into contact with the gradation scale 103 which is a portion of the resist layer to be inspected, are positioned on the gradation scale 103. Then, the measurement section tool is fixed by the magnetic force. Thereafter, the body of a squirt 140 for the inspecting solution only is inserted into a guide 132 used for dropping the inspecting solution SL. Under this condition, the inspecting solution SL is dropped through the nozzle of the squirt onto the resist electrodes 130 and 131 on the resist layer as shown in FIG. 19. The amount of dropped inspecting solution is not more than 100 $\mu$l; however, a predetermined amount of inspecting solution should be dropped at a time.

The principle of inspecting the permeation characteristic will be described. The resist layer is regarded as an electrical resistor. As the inspecting solution permeates the resist layer, the resistance between the copper surface of the gravure plate and the inspecting solution is changed, i.e., a short-circuit is formed therebetween. Accordingly, the inspection is carried out according to the time which elapses from the time instant that the inspecting solution is dropped until the short-circuit is formed.

FIG. 19 shows one example of the use of the measurement section tool. As is apparent from FIG. 19, the short circuit is formed between the resist electrodes 130 and 131 on which the inspecting solution is dropped and a cylinder electrode 133 which is connected to the copper layer 102 on which the resist layer 101 is formed. In the inspection, a circuit section in the measurement section tool and a measuring circuit section (described later) in the housing of the device body count the time required for the inspecting solution SL to permeate the resist layer. Referring back to FIG. 18, the clear key 125 is depressed to erase a displayed permeation time, while the key 125 is depressed when a displayed permeation time is inputted to a processing circuit (described later), and the same key is available at the main input section of the device body 200. The cylinder electrode 133 may be so designed that it is separated from the measurement section tool and is brought into close contact with the copper layer or iron base of the gravure plate.

Figure 20:
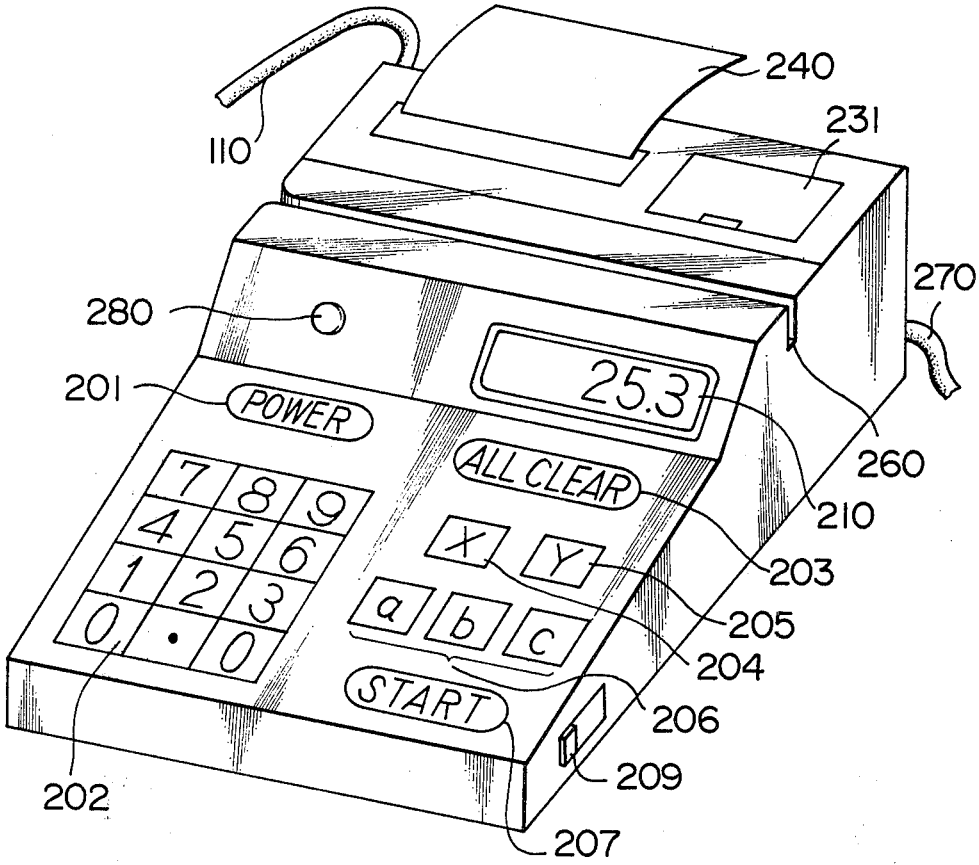
FIG. 20 is an explanatory diagram showing the external appearance of a calculating device body in the device in FIG. 17.
Figure 21:
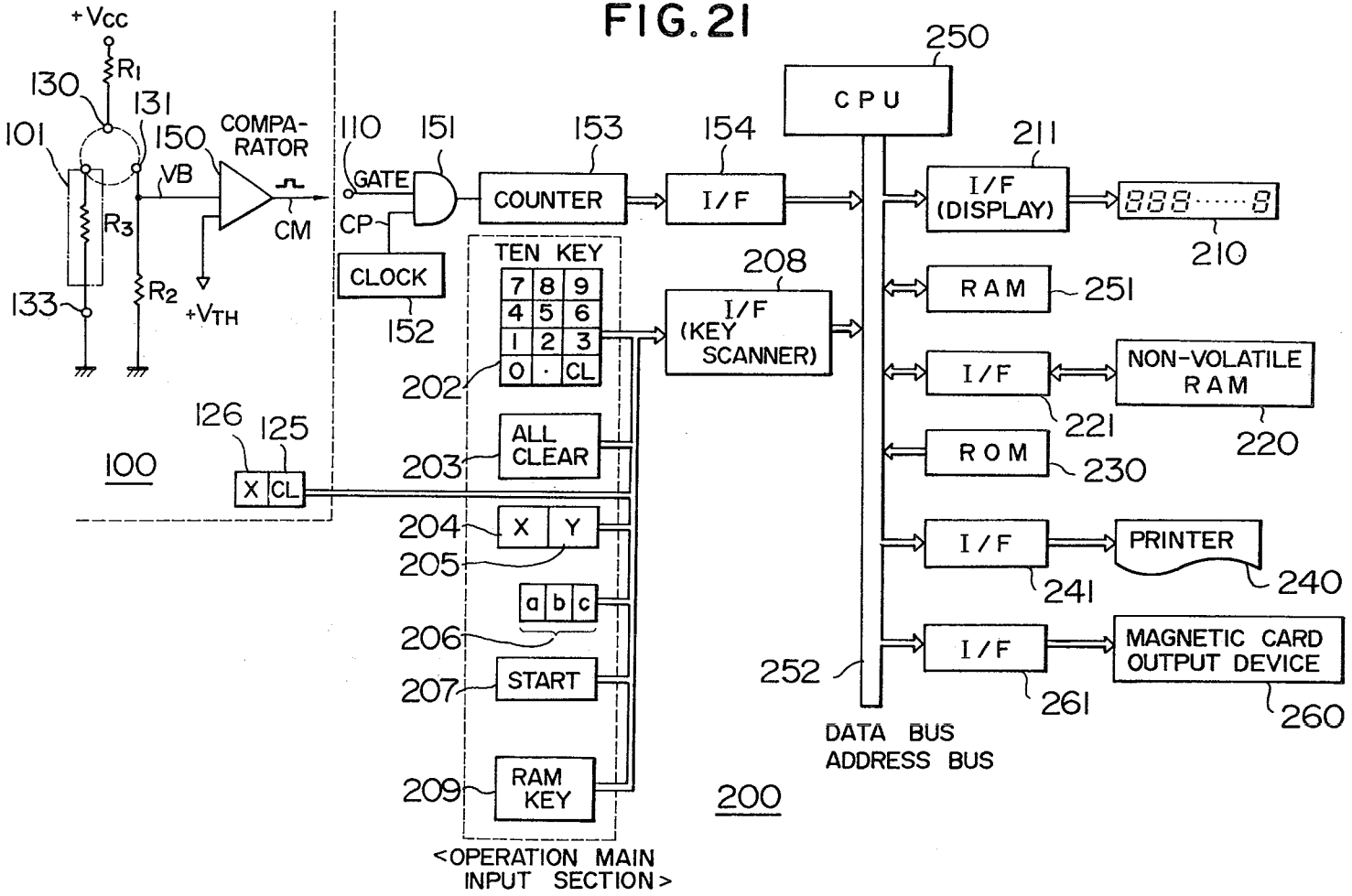
FIG. 21 is a block diagram showing a circuit in the device in FIG. 17.

FIG. 20 shows the device body 200 which is connected through the lead wire to the measurement section tool. The device body 200 can provide best etching conditions in the one bath etching process according to the invention. The device body 200 comprises the aforementioned measuring circuit section for counting the permeation time of the inspecting solution SL in the measurement section tool, a display section, an operation main input section, a processing section and a memory section, all of which are incorporated in one housing as shown in FIG. 20. FIG. 21 is a block diagram showing the device body with the measurement section tool.

The arrangement of the device body will be described with reference to FIGS. 20 and 21 in detail.

The device body is connected through the lead wire 110 to the measurement section tool. The device body comprises: a clock pulse generator 152 for generating pulses; a counter 153 for performing a counting operation; an interface 154 thereof; a CPU (microprocessor) 250; a display section 210; an interface 211 thereof; a ten-key 202, an ALL CLEAR key 203; an X key 204; a Y key 205; an a-b-c key 206; a START key 207; a RAM key 209 and a key scanner 208; a RAM (random access memory) 251; a non-volatile RAM 220; a ROM (read-only memory 230; a magnetic card output device (card writer) 260 for writing operation results in magnetic cards; an interface 261 thereof; a printer 240 for printing out data; and an interface 241 thereof. The circuit elements 202 through 208 form the operation input section, and the memories 251, 220 and 230 form the memory circuit section. The CPU 250, the input sections 154 and 208, the output sections 211, 241 and 261 and the memory sections 221, 230 and 251 are coupled through data and address buses (indicated at 252) to one another.

When the power switch 201 is turned on, the device becomes ready for measurement. In this operation, the resist electrode 131 is grouned through the resistor R2. Therefore, the potential $V_B$ is OV as indicated between the time instants $Z_0$ and $Z_1$ in the part (A) of FIG. 4, which is lower than the threshold potential $+V_{TH}$. Accordingly, the output of the comparator 150 is at a logical level "0" (hereinafter referred to merely as "0", when applicable) (cf. the part (B) of FIG. 4) and the clock pulse produced at a predetermined frequency by the clock pulse generator 152 is blocked by the AND circuit 151. Therefore, in this case, the counter 153 carries out no counting operation.

Under this condition, the inspecting solution SL is dropped on the resist electrodes 130 and 131 on the resist layer 101 with the squirt 140. The inspecting solution SL is electrically conductive and is brought into contact with the resist layer 101 and the resist electrodes 130 and 131. Accordingly, current from the power source +Vcc flows through the resistor R1 into the resistor R2 and the resist layer which is represented by the resistor $R_3$ in FIG. 20. Therefore, the potential $V_B$ is a voltage division value $V_M$ which is determined by the composite resistance of the resistances of the resistors R1, R2 and R3 (cf. the part (A) of FIG. 4). The value $V_M$ is applied to the comparator 150. As the value $V_M$ is higher than the threshold potential $+V_{TH}$, the output CM of the comparator 150 is raised to a logical level "1" (hereinafter referred to merely as "1", when applicable) (cf. the part (B) of FIG. 4). Therefore, the clock pulse CP is applied through the AND circuit 151 to the counter 153; that is, the counter 153 starts its counting operation. As the inspecting solution SL permeates the resist layer 101 gradually, the potential $V_B$ is gradually decreased, and becomes lower than the threshold potential $V_{TH}$ at the time instant $Z_2$. At the same time, the output CM of the comparator 150 is set to "0" again. Therefore, the clock pulse CP from the clock pulse generator 152 is blocked by the AND circuit 151, and the counting operation of the counter 153 is suspended. The pulses CP which are outputted for a period of time which elapses from the time instant that the inspecting solution SL is dropped on the resist layer 101 until the inspecting solution SL permeates the resist layer to a predetermined depth (corresponding to the threshold potential $V_{TH}$) are counted by the counter 153, and the count value of the counter 153 is applied through the interface 154 to the CPU 250, where it is converted into time data. The time data is applied through the data bus to the RAM 251, and is applied through the display interface 211 to the display section 210 where the permeation time (in seconds) is displayed.

When the permeation time displayed on the display section 210 is acceptable, the input instruction X key 126 in the manual operation section on the measurement section tool 100 or the input instruction X key 204 in the operation main input section of the device body is depressed, so that the permeation time is stored as etching condition calculating data in the RAM 251. The count value of the counter 153 and the display value of the display section 210 are cleared by depressing the clear key in the manual operating section or the clear key of the ten-key 202 in the operation main input section. The above-described permeation time measurement is carried out for each of the gradation portions A, B, C and D of the gradation scale 3, and the permeation times thus measured are stored, as etching condition calculating data, in the RAM 251.

The display section 210 operates to display the above-described inspecting solution permeation time in seconds, or the cell setting depths of the gradations A, B, C and D of the gradation scale in microns. That is, the display section not only allows the operator to visually check input data but also indicates whether or not etching can be carried out under etching conditions which have been finally determined through operation. In other words, the display section can determine in advance whether or not a one-bath etching process with a predetermined density can be applied to the resist layer. The display is made to the first decimal place by means of liquid crystal or photo-electric elements. The method of displaying data may be so modified that the input data are shifted horizontally whereby the input data of the gradation portions A, B, C and D can be observed successively.

The operation main input section comprises: a power switch 201; the ALL CLEAR key 203 for instructing the standby of data inputs; the ten-key 202 for inputting inspecting solution permeation times and cell setting depths; the X key 204 for storing the inspecting solution permeation times of the portions A, B, C and D of the resist scale in predetermined addresses in the RAM 251; the Y key 205 for storing the cell setting depths of the resist portions A, B, C and D in predetermined addresses in the RAM 251; the etching setting curve specifying keys a, b and c (206); the START key for starting processing and instructing outputting; and the RAM key 209 for storing etching setting curves in predetermined addresses in the non-volatile RAM 220, which are in correspondence to the keys a, b and c (206).

The operations of these keys will be described in detail when the operation of the device is described with reference to the flow chart. The cell setting depths of the portions A, B, C and D of the resist scale, which are of the typical etching curves, are stored in the non-volatile RAM. The depths thus stored can be selected in one action by selectively operating the keys a, b and c. The number of keys a, b and c is not limited, or the keys a, b and c may be omitted. In the latter case, the cell setting depths are inputted by operating the ten-key or the Y key.

The memory circuit section comprises: the RAM 251, the non-volatile RAM 220 and the ROM 230. In the non-volatile RAM 220, a nitron NC7055 for instance is used. The RAM switch 209 is turned on, so that the above-described etching setting curves are stored in the addresses in the non-volatile RAM, which are in correspondence to the keys a, b and c (206), by means of the ten-key and the Y key. The comparison test data of the permeation times of etching solutions having predetermined densities and the permeation times of inspecting solutions (cf. FIG. 14), and the test data on the relationships between inspecting solution permeation times and copper suface etching speeds of etching solution with each of the gradations of the gradation scale when the cylinder is turned at various speeds (cf. FIG. 23), which data are required for an operation (described later), are stored in the ROM 230, and are interchangeably stored in the cover 231. If etching solutions are equal in density, then a ROM is formed for every density as they can be widely used. In the case where etching solutions different in density are used, they are suitably exchanged for one another, or more than one ROM are formed in advance. In the latter case, a changeover switch is used to selectively employ the ROM which is in agreement with an etching solution which is to be used. More specifically, the etching solutions are put in different tanks, and only one etching solution is selected which has a density suitable for a resist layer which is to be etched. The device according to the invention can control the etching conditions of a plurality of etching machines with ROMs stored in conformance with the characteristics of the etching machines.

The following methods may be employed for storing the test data in the ROM 230: The test data may be stored in the ROM according to an approximate functional equation $t=a\times b$ in FIG. 22 (where t is the etching solution permeation time, x is the inspecting solution permeation time, and a and b are the constants which are determined for each of the etching solutions different in density). Alternatively, the etching solution permeation times t may be stored by providing a data table having inspecting solution permeation times x set at time intervals of 0.5 second for instance. The copper surface etching speeds $\Delta y$ with the cylinder rotational speeds as parameters in FIG. 23 may be also stored by providing a data table having inspecting solution permeation times x set at time intervals of 0.5 second.

Figure 24:
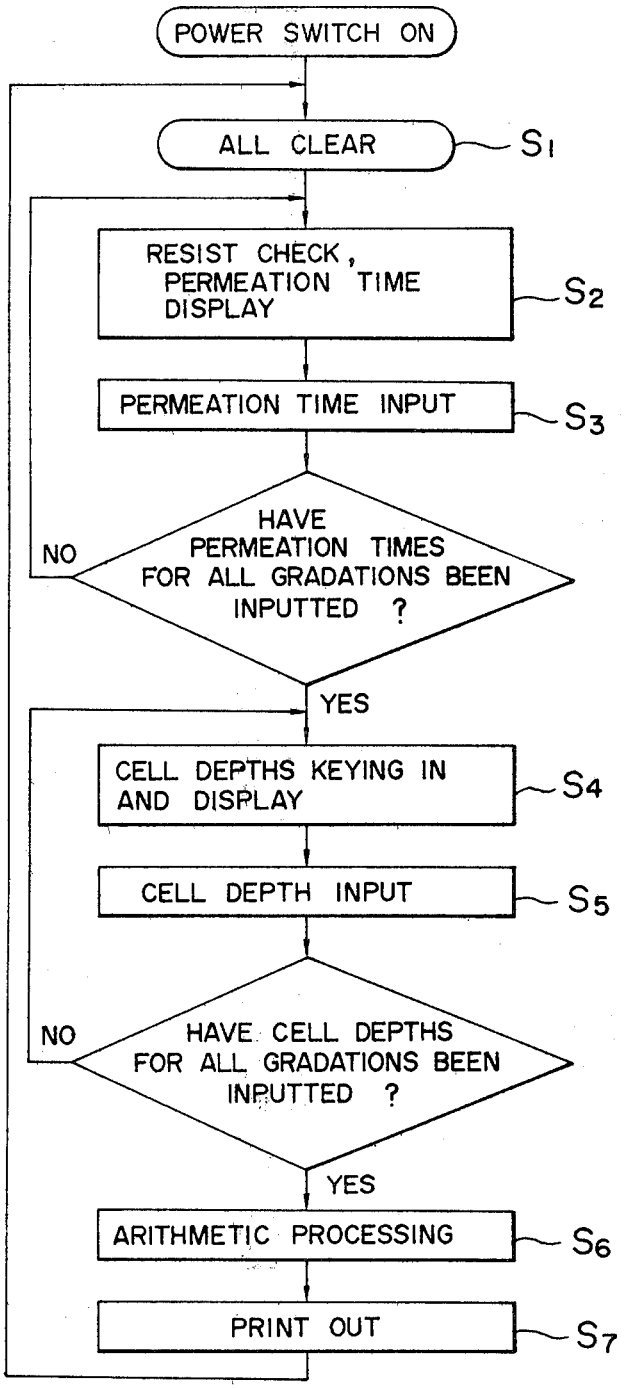
FIG. 24 is a flow chart for a description of the operation of the device in FIG. 17.

The operations of the CPU 250 and the output sections 240 and 260 will be described with reference to a flow chart in FIG. 24.

When the ALL CLEAR key 203 is depressed after the power switch 201 is turned on (turning on the power source lamp 208) (Step S1), the data input standby preparation is specified. The measurement section tool 100 is set at the gradation scale 103 on the resist layer 101, and the inspecting solution permeation times x of the gradation portions A, B, C and D are checked one after another (Step S2). The permeation times are displayed on the display section 210, and are stored in the RAM 251 by the operation of the X key 204 successively (Step S3). Thereafter, the ten-key 202 or the cell setting curve keys a, b and c are operated to read the cell setting depth y for each of the gradation portions A, B, C and D out of the non-volatile RAM 220, and the cell setting depth y thus read is displayed in a digital mode on the display section 210 (Step S4). If the cell setting depth thus displayed is acceptable, the cell setting depth is stored in the RAM 251 by operating the Y key 205 (Step S5). In this case, it is necessary that the data inputting sequence is so determined that the data are inputted successively beginning with the data on the shadow side or on the high light side, and that the data are inputted in such a manner that inspecting solution permeation time X key input values are in correspondence to cell setting depth Y key input values.

After the data inputting operation has been accomplished by operating the keys as described above, the START key 207 is depressed. As a result, an operation is carried out according to a predetermined calculation procedure programmed in the CPU section 250 (Step S6), so that the total etching time, etching distribution times and rotational speeds as shown in FIG. 25 are outputted by the output printer 240 and the magnetic card output device 260 (Step S7).

Figure 26:
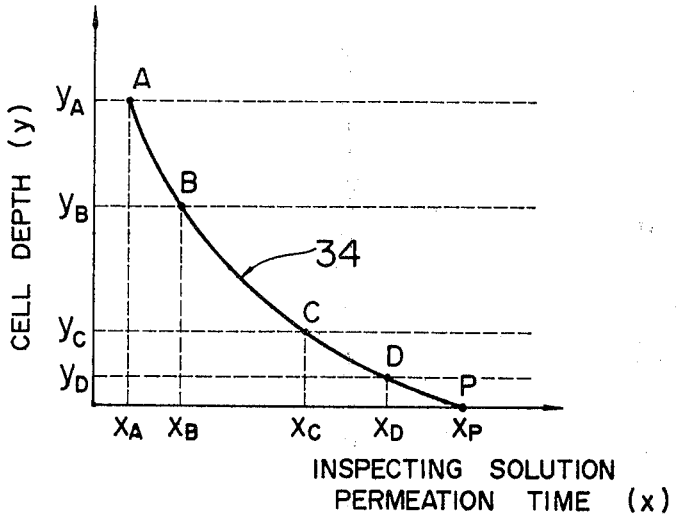
FIG. 26 is a characteristic diagram showing the relationships between inspecting solution permeation times and set cell depths in the case of a gravure plate resist layer.

FIG. 26 indicates the relationships between the inspecting solution permeation times $X_A$, $X_B$, $X_C$ and $X_D$ and the cell setting depth $Y_A$, $Y_B$, $Y_C$ and $Y_D$ of the gradation portions A, B, C and D which are inputted. That is, by performing an etching operation under etching conditions which satisfy four plot points A, B, C and D in FIG. 26, a cell depth curve can be obtained as set.

Figure 22:
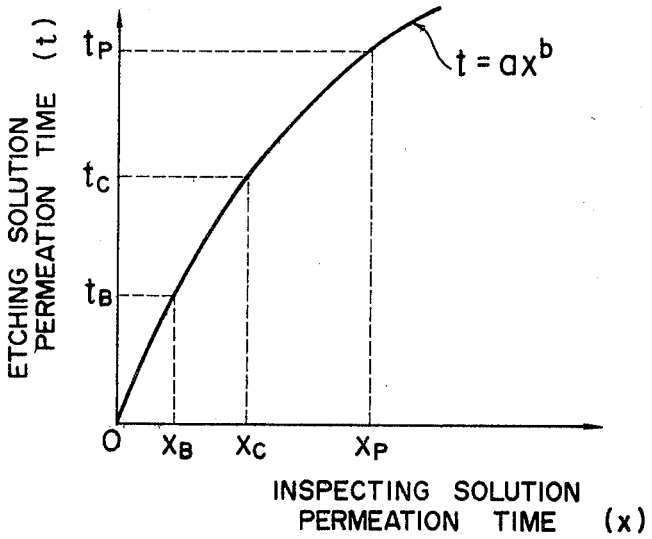
FIG. 22 is a characteristic diagram showing the permeation times of an inspecting solution and an etching solution applied to a gravure plate resist layer.

First, the point where the permeation characteristic curve 34 and the x-axis in FIG. 26 intersects, i.e., the point p where the cell depth $y=0$ is estimated, so that an inspection solution permeation time $x_p$ at that point p is obtained. An etching solution permeation time $t_p$ corresponding to the inspecting solution permeation time $x_p$ is obtained from the ROM 230 as shown in FIG. 22. The etching solution permeation time $t_p$ is determined as the total etching time. The point p may be determined by actually measuring the portion of the resist layer where $y=0$ should be held, or the point p may be calculated as a point at which the x-axis and a straight line connecting two points ($x_C$, $y_C$) and ($x_D$, $y_D$) intersect. Alternatively, the point p may be obtained as the intersection of the x-axis and a tangential line at the point ($x_D$, $y_D$) on the curve 34 in FIG. 26.

After the total etching time $t_p$ has been determined as described above, two points B and C providing halftone are selected as etching conditions branch points; that is, the etching operation is divided into three parts: the first period between the start and the point B, the second period between the point B and the point C, and the third period between the point C and the etching end point P, so that etching distribution times and cylinder rotational speeds are calculated for the three periods. In this case, the number of intermediate points is not limited; however, at any rate, the etching conditions are divided at those points.

Etching solution permeation times $t_B$ and $t_C$, which correspond to the inspecting solution permeation times $x_B$ and $x_C$ at the branch points B and C, are obtained from the ROM 230 in which the functional equation as shown in FIG. 22 is stored, and the etching distribution time for each of the three periods is determined as follows:

| | |
|---|---|
| First period (between the etching start point and the point B) | $t_B$ |
| Second period (between the points B and C) | $t_C$-$t_B$ |
| Third period (between the points C and P) | $t_P$-$t_C$ |
| Total etching time | $t_P$ |

Figure 23:
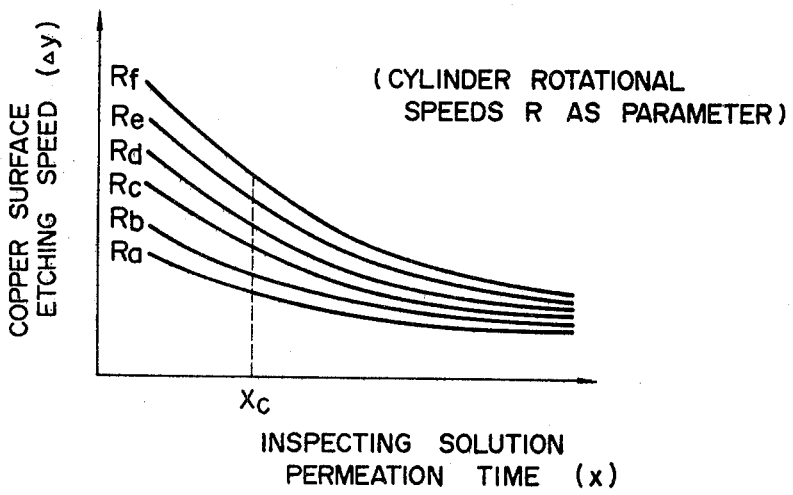
FIG. 23 is a characteristic diagram indicating inspecting solution permeation times with copper surface etching speeds of an etching solution, with various gravure cylinder rotational speeds.

On the other hand, the cylinder rotational speeds for the three periods are determined beginning with that for the third period as follows:

In order to determine the cylinder rotational speed for the third period, an etching solution's copper surface etching speed $\Delta y$ such as a cylinder rotational speed corresponding to the inspecting solution permeation time $x_C$ at the point C is obtained from the ROM 230 in which the data as shown in FIG. 23 are stored in the form of a table. Then, the amount of etching per actual etching time is multiplied by an actual etching time $\theta_C$ at the point C, to calculate an etching cell depth for every cylinder rotational speed. This value is compared with the set cell depth $y_C$, so that a cylinder rotational speed, such as Ra, which shows a value closest to $y_C$, is selected for the third period. The aforementioned real etching time $\theta_C$ is obtained by subtracting the etching permeation time $t_C$ at the point C from the total etching time; that is, it is the period of time for which the etching solution which has reached the copper surface of the cylinder actually etches the copper surface, or the third period $t_P-t_C$.

Figure 27:
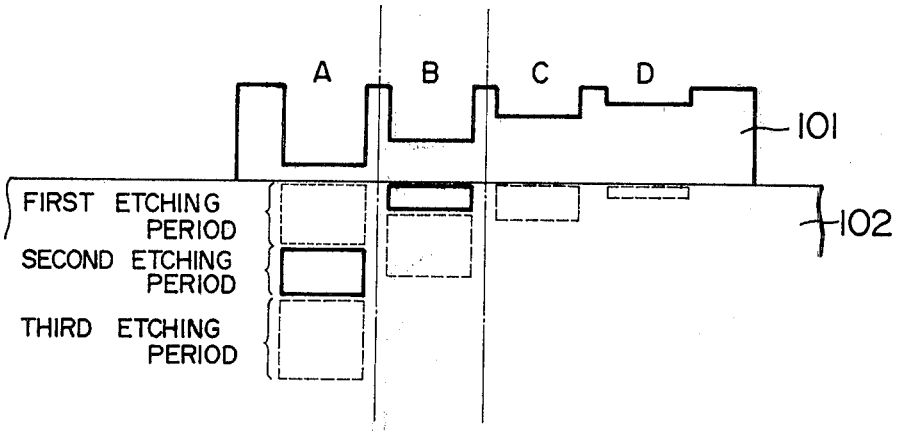
FIG. 27 is a vertical sectional view showing the resist layer and the copper layer of a gravure plate material.

The cylinder rotational speed for the second period is determined as follows: Etching cell depths for the three etching periods are as shown in FIG. 27 for instance. In FIG. 27, the dotted lines on the copper layer 102 indicate the etching cell depths under the first period etching conditions, the solid lines indicate the etching cell depths under the second period etching conditions, and the broken lines indicate the etching cell depths under the third period etching conditions. That is, the copper layer is etched stepwise over the first, second and third etching periods, and the cell depth in each etching period is correlated with the cylinder rotational speed or actual etching time in the etching period. Accordingly, border lines (as indicated by the one-dot chain lines (a) and (b)) is formed by the variations in cylinder rotational speed between the first and second etching periods and between the second and third etching periods.

A portion of the resist layer, the inspecting solution permeation time is longer than that of the border line (b), is affected as much as the cylinder rotational speed of the third etching period. A portion of the resist layer, the inspecting solution permeation time is between those of the border lines (a) and (b), is affected by the cylinder rotational speeds of the second and third etching periods. A portion of the resist layer, the inspecting solution permeation time of which is shorter than that of the border line (a), is affected by the cylinder rotational speeds of all of the first, second and third etching periods. Accordingly, the rotational speed of the second etching period can be calculated from the cell depth (indicated by the solid line in FIG. 20) which can be obtained by subtracting the cell depth (indicated by the broken line in FIG. 20) correlated to the rotational speed Ra of the third etching period from the set cell depth $y_B$ at the point B.

This amount of subtraction corresponds to an etching cell depth of the resist layer at the point B under the etching conditions that are the cylinder rotational speed Ra and the actual etching time $\theta_C$, and can be obtained by utilizing FIG. 23.

In other words, the amount of subtraction can be obtained as follows: A copper surface etching speed data $\Delta y$ with the rotational speed Ra is obtained from FIG. 23 by utilizing the inspection solution permeation time at the point B, and is then multiplied by the actual etching time $\theta_C$.

The amount of subtraction of the resist layer at the point B is represented by $\Delta y_B'$ and a new point which is provided by subtracting the effect is represented by B'. Then, the set cell depth $y_B$, at the point B' is $y_B-\Delta y_{B'}$. The data $\Delta y_B$, corresponds to the portion indicated by the broken line at the point B in FIG. 12.

Similarly as in the determination of the cylinder rotational speed for the third etching period, an etching solution copper surface etching speed $\Delta y$ for every cylinder rotational speed with the inspection solution permeation time $x_B$ at the point B is obtained from FIG. 23, and this amount of etching per actual etching time is multiplied by the second period actual etching time $\theta_B$ at the point B, to calculate a set cell depth for every cylinder rotational speed. This value is compared with the above-described set cell depth $y_{B'}$ $(=y_B-\Delta y_{B'})$, so that a cylinder rotational speed (for instance Rc) which shows a value closest to $y_B$, is selected for the second etching period.

The actual etching time $\theta_B$ corresponds to a period of time which elapses from the time instant that the etching solution reaches the cylinder copper surface at the point B until it reaches the cylinder copper surface at the point C. That is, the actual etching time $\theta_B$ corresponds to a period of time $(t_P-t_B)$-$(t_P-t_C)$ for which the etching solution actually etches the cylinder copper surface at the point B, or the second etching period $t_C-t_B$.

Similarly as in the calculation of the cylinder rotational speed for the second etching period, the cylinder rotational speed for the first etching period can be calculated from a cell depth (as indicated by the dotted line in FIG. 27) which is obtained by subtracting the cell depth (indicated by the broken line in FIG. 27) due to the third period rotational speed Ra and the cell depth (indicated by the solid line in FIG. 27) due to the second period rotational speed Rc from the cell set depth $y_A$ at the point A.

The subtraction is similar to that in the case of the second etching period. A copper surface etching speed data with the rotational speed Ra is obtained from FIG. 23 by referring to the inspecting solution permeation time $x_A$ at the point A, and is multiplied by the actual etching time $\theta_C$ to calculate, for instance, $\Delta y_{A'}$. A new point A' is obtained by subtracting the data $\Delta y_{A'}$ from the data $y_A$. Furthermore, a copper surface etching speed data is obtained by referring to the inspecting solution permeation time $x_A$ and the rotational speed Rc and is multiplied by the actual etching time $\theta_B$ to calculate for instance, $\Delta y_{A''}$. A new point A'' is obtained by subtracting this effect. The set cell depth $y_{A''}$ at the point A'' is $(y_A-\Delta y_{A'}-\Delta y_{A''})$. The data $\Delta y_{A'}$ corresponds to the portion indicated by the broken line at the point A in FIG. 27, and the data $\Delta y_{A''}$ corresponds to the portion indicated by the solid line at the point A in FIG. 27.

Similarly as in the determination of the cylinder rotational speed for the second etching period, a copper surface etching speed $\Delta y$ for every cylinder rotational speed with respect to the inspecting solution permeation time $x_A$ at the point A is obtained from FIG. 23, and this amount of etching per actual etching time is multiplied by the first period actual etching time $\theta_A$ at the point A to calculate an etching cell depth for every cylinder rotational speed. This value is compared with the aforementioned set cell depth $y_{A''}$ $(=y_A-/y_{A'}--/y_{A''})$, and a cylinder rotational speed (for instance Rb) which shows a value closest to $y_{A''}$ is selected for the first etching period.

The actual etching time $\theta_A$ is a period of time $(t_P-t_A)$-$(t_P-t_B)$ which elapses from the time instant that the etching solution reaches the cylinder copper surface of the point A until the etching solution reaches the cylinder copper surface of the point B. For the period of time, the etching solution actually etches the cylinder copper surface of the point A.

Thus, the cylinder rotational speeds can be calculated as follows:

First period (between the etching start point and the point B): Rb

Second period (between the points B and C): Rc

Third period (between the points C and P): Ra

Accordingly, when the etching distribution times and the cylinder rotational speeds are employed successively beginning with the first period etching conditions, the gradation portions A, B, C and D are etched according to the set cell depths, and an ideal etching reproduction curve is obtained.

The above-described calculation procedure is merely one example; that is, the invention is not limited to the algorithm. Etching conditions higher in accuracy may be set by providing the measurement data in the form of functions according to a smooth approximate expression.

When the above-described calculation is accomplished by using the memory data in the CPU section 250, for instance the output section 240 prints out input data and output data on the printing sheet. The input data are outputted in order to detect input errors. The total etching time, the etching distribution times and cylinder rotational speeds for the first, second and third etching periods, the cell etching depths which are estimated when etching is carried out under the preset etching conditions, and the errors with respect to the cell set depths are printed out as the output data, so that it can be determined in advance whether or not a resist layer to be etched can be etched under the etching conditions which have been calculated through operation. If "NO" is displayed or printed out; that is, when it is determined that the resist layer cannot be etched under the etching conditions, a method may be employed in which the resist layer is replaced with a new one, or new etching conditions are provided with the etching solution replaced with another one different in density. In outputting these data, a printing sheet may be used, or a magnetic card output device (or a card writer) may be employed, or the etching machine may be provided with an exclusive interface for in-line operation. The etching machine, being under simple sequence control, can carry out a one-bath etching process according to the calculated etching conditions. That is, the etching machine is completely automatically operated at low cost.

The stand 300 is provided beside the device body 200, so as to receive the measurement section tool 100 when not used. Therefore, if a material such as an ink blotter excellent in liquid absorption is set on the stand 300, then the inspecting solution remaining on the resist electrodes of the measurement section tool can be readily eliminated.

The device body may be provided with a cover.

It is originally desirable that the lead wire 110 is as short as possible and the length of the lead wire is selected to the extent that the person at the measurement section tool can visually detect the display value on the device body. However, the lead wire may be of several meters, so that it can be extended when required.

Furthermore, the resist inspecting section may be separated as a single unit, so that the etching condition calculating device is used as a portable one to calculate etching conditions from the inspecting solution permeation time x and the set cell depth y inputted thereto.

As is apparent from the above description, best etching conditions which are in agreement with the characteristic of a resist layer to be etched can be calculated before the etching operation according to the invention. Therefore, the invention provides the following effects or merits:

(1) The etching operation can be achieved under preset control. The rotational speed variable one bath etching system is operated stably, efficiently and automatically.

(2) According to the invention, the etching operation is carried out under the best etching conditions. Therefore, cell depths excellent in reproducibility can be given to a gravure plate material merely through etching process control according to the gradations of an image even by an unskilled person. Thus, the gravure plate provided according to the invention is stable and high in quality.

(3) As the gravure plate provided according to the invention is stable and high in quality, the troublesome work that the plate must be corrected later is greatly relieved.

(4) The etching operation is carried out under the best etching conditions, and in this operation only one etching solution having a predetermined density is used. Accordingly, not only the etching procedure but also the etching equipment can be simplified. Therefore, the accurate etching operation can be automatically carried out with the simple etching machine.

(5) According to the invention, it can be determined whether or not the etching operation can be carried out under the calculated etching conditions before the etching operation. Accordingly, the device can be used as a resist inspecting unit. When the resist of a gravure plate material is detected unsatisfactory, the gravure plate can be used by replacing the resist only. Thus, the gravure plate material high in cost can be economically used according to the invention.

What is claimed is:

1. A one-bath etching process in which, in forming gravure cells in the surface of a gravure cylinder by supplying an etching solution having a predetermined density, cell depths are controlled by varying the rotational speed of said cylinder; in which data on relations between inspecting solution permeation times of a resist layer on said cylinder and set cell depths are compared with reference data which include data on relationships between inspecting solution permeation times and etching solution permeation times, with respect to the gradations of a testing gradation scale, of said resist layer and data on relationships between inspecting solution permeation times and cell depths with respect to the combinations of etching times and cylinder speeds, to obtain a total etching time and a cylinder speed before said etching solution is supplied, and thereafter said cylinder is etched according to said total etching time and cylinder speed thus obtained.

2. A one-bath etching process in which, in forming gravure cells in the surface of a gravure cylinder by supplying an etching solution having a predetermined density, cell depths are controlled by varying the rotational speed of said cylinder, in which (a) relationships between inspecting solution permeation times and etching solution permeation times, with respect to the gradations of a testing gradation scale, of a resist layer on said gravure cylinder, (b) relationships between inspecting solution permeation times and cell depths with respect to the combinations of etching times and cylinder speeds, and (c) relationships between inspecting solution permeation times and cell depths with respect to the combinations of actual etching times and said cylinder speeds, are obtained, and before said etching solution is supplied, (d) relationships between inspecting solution permeation times and set cell depths, with respect to the gradations of said gradation scale, of said resist layer is detected, (e) a total etching time is detected from data in paragraphs (a) and (d) above, (f) data in paragraph (b) corresponding to said total etching time detected in paragraph (e) and data in paragraph (d) are subjected to comparison, to detect a cylinder speed to be used in the N-th etching period and the (N−1)th turnout point, (g) an etching time for the N-th etching period is detected from data in paragraphs (a) and (f), (h) an actual etching time at said (N−1)th turnout point with said cylinder speed to be used in said N-th etching period which has been detected in paragraph (g), (i) said relationship in paragraph (c) which corresponds to said actual etching time detected in paragraph (h) and said cylinder speed detected in paragraph (f) is subtracted from said relationships in paragraph (d), and relationships between inspecting solution permeation times and cell depths in etching periods before said (N−1)th turnout point, are detected, (j) an etching time before the N-th etching period according to the data in paragraphs (a) and (i), and (k) data in paragraph (b) corresponding to said etching time which has been detected in paragraph (j) is compared with data in paragraph (i), to detect a cylinder speed to be used in etching before the N-th etching period, and (l) detection of the (N−2)th turnout points similarly to that in paragraph (f) which is carried out in succession with paragraph (k) when N is three (3) or more and detection of cylinder speeds and etching times for the (N−2)th through first etching periods by repeating the operations in paragraphs (g) through (k) are carried out, and thereafter while said etching solution is being supplied, etching operations for the first, second, third, . . . and N-th etching periods are carried out with the respective cylinder speeds and etching times in the stated order.

3. A device for calculating etching conditions in processing a gravure plate, which comprises a measurement section tool and a calculating device body, to calculate etching conditions in a rotational speed variable one bath etching method from relationships between inspecting solution permeation times and set cell depths with respect to the gradations of a gradation scale on a gravure plate resist layer, said measurement section tool comprising: a tool body to be mounted on the resist layer of a gravure plate material; an element for dropping an inspecting solution onto said gradation scale on said resist layer; resist electrodes which is held by said tool body so as to be brought, through said inspecting solution, into contact with a portion of said resist layer to be inspected; and a plate material electrode which is coupled to said tool body and connected to said gravure plate material, said calculating device body comprising: a measurement circuit for measuring a measurement signal provided by said measurement section tool; an operation main input section for forming operation input signals; a memory section for storing basic data which are required in advance; a processing section for performing calculation according to inputs from said measuring, to calculate most suitable etching conditions; and an output section.

4. A device as claimed in claim 2, in which said measurement section tool comprises electrode guides which are extended from said tool body, to prevent said resist electrodes from contacting said gravure plate material.

5. A device as claimed in claim 2, in which said measurement section tool has key means for applying measurement signals to said calculating device body.

* * * * *